US006804358B1

(12) United States Patent
Kawano

(10) Patent No.: US 6,804,358 B1
(45) Date of Patent: Oct. 12, 2004

(54) SOUND IMAGE LOCALIZING PROCESSOR

(75) Inventor: Seiji Kawano, Nishinomiya (JP)

(73) Assignee: Sanyo Electric Co., LTD, Osaka (JP)

( * ) Notice: Subject to any disclaimer, the term of this patent is extended or adjusted under 35 U.S.C. 154(b) by 0 days.

(21) Appl. No.: 09/581,534

(22) PCT Filed: Dec. 28, 1998

(86) PCT No.: PCT/JP98/06010

§ 371 (c)(1),
(2), (4) Date: Oct. 24, 2000

(87) PCT Pub. No.: WO99/35885

PCT Pub. Date: Jul. 15, 1999

(30) Foreign Application Priority Data

Jan. 8, 1998 (JP) ..... 10-002162

(51) Int. Cl.[7] ..... H04R 5/00
(52) U.S. Cl. ..... 381/17; 381/61; 381/1
(58) Field of Search ..... 381/1, 17, 18, 381/61, 19

(56) References Cited

U.S. PATENT DOCUMENTS

| | | | | |
|---|---|---|---|---|
| 5,995,631 A | * | 11/1999 | Kamada | 381/17 |
| 5,999,630 A | * | 12/1999 | Iwamatsu | 381/18 |
| 6,052,470 A | * | 4/2000 | Mouri | 381/17 |

FOREIGN PATENT DOCUMENTS

| | | | |
|---|---|---|---|
| JP | 52-125301 | A | 10/1977 |
| JP | 53009501 | | 1/1978 |
| JP | 4-79600 | A | 3/1992 |
| JP | 04150400 | A | 5/1992 |
| JP | 05300597 | A | 11/1993 |
| JP | 06178397 | A | 6/1994 |
| JP | 07015395 | A | 1/1995 |
| JP | 07212897 | | 8/1995 |
| JP | 08152893 | A | 6/1996 |
| JP | 09009398 | A | 1/1997 |
| JP | 09187100 | | 7/1997 |
| JP | 9-200897 | A | 7/1997 |
| JP | 09215100 | A | 8/1997 |
| JP | 10042397 | | 2/1998 |
| JP | 10136497 | | 5/1998 |
| WO | WO 97/37514 | | 10/1997 |

* cited by examiner

*Primary Examiner*—Minsun Harvey
(74) *Attorney, Agent, or Firm*—Arent Fox PLLC

(57) ABSTRACT

A sound image localization processor comprises a first processing circuit 10 receiving a sound left signal and comprising a first delay unit 11 and a first sound image localization filter 12, a second processing circuit 20 receiving a surround right signal and comprising a second delay unit 21 and a second sound image localization filter 22, an adder 1 for adding the surround left signal and an output signal of the second processing circuit 20 and outputting the result of the addition as a voice signal to a left loudspeaker located ahead of a listener, and an adder 2 for adding the surround right signal and an output signal of the first processing circuit 10 and outputting the result of the addition as a voice signal to a right loudspeaker located ahead of the listener.

6 Claims, 9 Drawing Sheets

SOUND IMAGE LOCALIZING PROCESSOR

TECHNICAL FIELD

The present invention relates to a sound image localization processor for making a listener feel without using a surround loudspeaker as if a surround signal of a two-channel stereo were outputted from the surround loudspeaker using two loudspeakers located ahead of the listener.

BACKGROUND ART

FIG. 6 illustrates a conventional sound image localization processing circuit.

A surround left signal SL inputted to an input terminal P1 is fed to a first sound image localization filter 101 and a second sound image localization filter 102. In each of the filters 101 and 102, filter processing corresponding to a filter coefficient of the filter is performed.

A surround right signal SR inputted to an input terminal P2 is fed to a third sound image localization filter 103 and a fourth sound image localization filter 104. In each of the filters 103 and 104, filter processing corresponding to a filter coefficient of the filter is performed. The characteristics of the first sound image localization filter 101 and the characteristics of the fourth sound image localization filter 104 are the same, and the characteristics of the second sound image localization filter 102 and the characteristics of the third sound image localization filter 103 are the same.

An output of the first sound image localization filter 101 and an output of the third sound image localization filter 103 are added together in an adder 111, and the result of the addition is outputted as $L_{OUT}$. The output $L_{OUT}$ is fed to a left loudspeaker located at the left and ahead of a listener.

An output of the second sound image localization filter 102 and an output of the fourth sound image localization filter 104 are added together in an adder 112, and the result of the addition is outputted as $R_{OUT}$. The output $R_{OUT}$ is fed to a right loudspeaker located at the right and ahead of the listener.

Each of the sound image localization filters is found by a head transmission function, described below. Generally used as the sound image localization filter is an FIR (Finite Impulse Response) digital filter having several hundred taps.

Description is made of a method of calculating a sound image localization filter using a head transmission function.

As shown in FIG. 7, let $H_{LL}$, $H_{LR}$, $H_{RL}$, and $H_{RR}$ be respectively transmission functions for each transmission path from real loudspeakers L and R arranged at the left and right and ahead of a listener 100 to the left and right ears of the listener 100. Let $W_L$ and $W_R$ be respectively transmission functions from a virtual sound source position P where a sound is desired to be localized to the left and right ears of the listener 100. All the transmission functions are described on the frequency axis.

In order that a voice can be heard by the listener 100 as if it were outputted from the virtual sound source position irrespective of the fact that the voice is outputted from the real loudspeakers L and R, the following equation (1) must hold, letting X be an input signal, and letting $L_{OUT}$ and $R_{OUT}$ be respectively output signals from the real loudspeakers L and R.

$$\begin{pmatrix} W_L \\ W_R \end{pmatrix} X = \begin{pmatrix} H_{LL} & H_{LR} \\ H_{RL} & H_{RR} \end{pmatrix} \begin{pmatrix} L_{OUT} \\ R_{OUT} \end{pmatrix} \tag{1}$$

Consequently, the signals $L_{OUT}$ and $R_{OUT}$ respectively outputted from the real loudspeakers L and R are found by the following equation (2):

$$\begin{pmatrix} L_{OUT} \\ R_{OUT} \end{pmatrix} = \frac{1}{H_{LL}H_{RR} - H_{LR}H_{RL}} \begin{pmatrix} H_{RR} & -H_{LR} \\ -H_{RL} & H_{LL} \end{pmatrix} \begin{pmatrix} W_L \\ W_R \end{pmatrix} X \tag{2}$$

Furthermore, if it is assumed that the real loudspeakers L and R are located so as to be bilaterally symmetrical , as viewed from the listener 100, the transmission functions which are bilaterally symmetrical are the same. Accordingly, the following equations (3) and (4) hold. The same transmission functions are respectively taken as $H_{THR}$ and $H_{CRS}$.

$$H_{THR}=H_{LL}=H_{RR} \tag{3}$$

$$H_{CRS}=H_{LR}=H_{RL} \tag{4}$$

Consequently, the foregoing equation (2) can be rewritten to the following equation (5):

$$\begin{aligned} \begin{pmatrix} L_{OUT} \\ R_{OUT} \end{pmatrix} &= \frac{1}{H_{LL}H_{RR} - H_{LR}H_{RL}} \begin{pmatrix} H_{RR} & -H_{LR} \\ -H_{RL} & H_{LL} \end{pmatrix} \begin{pmatrix} W_L \\ W_R \end{pmatrix} X \\ &= \frac{1}{H_{THR}^2 - H_{CRS}^2} \begin{pmatrix} H_{THR} & -H_{CRS} \\ -H_{CRS} & H_{THR} \end{pmatrix} \begin{pmatrix} W_L \\ W_R \end{pmatrix} X \\ &= \begin{pmatrix} \dfrac{H_{THR}W_L - H_{CRS}W_R}{H_{THR}^2 - H_{CRS}^2} \\ \dfrac{H_{THR}W_R - H_{CRS}W_L}{H_{THR}^2 - H_{CRS}^2} \end{pmatrix} X \\ &= \left(\frac{H_1}{H_2}\right) X \\ &\begin{pmatrix} H_1 = \dfrac{H_{THR}W_L - H_{CRS}W_R}{H_{THR}^2 - H_{CRS}^2} \\ H_2 = \dfrac{H_{THR}W_R - H_{CRS}W_L}{H_{THR}^2 - H_{CRS}^2} \end{pmatrix} \end{aligned} \tag{5}$$

As a filter in which $H_1$ and $H_2$ in the equation (5) are converted into time axes, an FIR digital filter having several hundred taps is used.

The frequency characteristics of the first sound image localization filter 101 and the fourth sound image localization filter 104 shown in FIG. 6 correspond to $H_1$ in the equation 5, and the frequency characteristics of the second sound image localization filter 102 and the third sound image localization filter 103 correspond to $H_2$ in the equation 5.

The FIR digital filter is generally realized by a digital processor such as DSP (Digital Signal Processor). When the DSP, for example, is used for this processing, the number of processing steps required therefor is approximately the same as the number of taps of the FIR digital filter. As the overall amount of processing, therefore, processing whose amount is four times the number of taps of the FIR digital filter is required because there are four FIR digital filters.

Specifically, 1000 or more processing steps are required for the digital signal processor. Further, the FIR digital filter found by such a calculating method generally has complicated frequency characteristics. Therefore, a signal which has been subjected to FIR digital filter processing reasonably has a sharp peak dip, so that it becomes a sound which is unnatural and has an uncomfortable feeling. An example of the frequency characteristics of the FIR digital filter used for sound image localization is shown in FIG. 8.

FIG. 9 illustrates a circuit for reproducing a multi-channel audio signal such as DolbyDigital or MPEG only on two channels utilizing the sound image localization processing technique shown in FIG. 6. In FIG. 9, the same portions as those shown in FIG. 6 are assigned the same reference numerals.

A left signal L and a right signal are added to a signal obtained by subjecting a center signal C to gain control of −3 dB by a multiplier 121, respectively, by an adder 113 and an adder 114.

An output of the adder 113 and the output of the adder 111 described in FIG. 6 are added together by an adder 115, and the result of the addition is taken as an output $L_{OUT}$ to a left loudspeaker. An output of the adder 114 and the output of the adder 112 described in FIG. 6 are added together by an adder 116, and the result of the addition is taken as an output $R_{OUT}$ to a right loudspeaker.

Also in such a circuit, much of the processing is processing of the FIR digital filter for sound image localization of a surround signal, so that a large burden is imposed on the DSP. Further, the FIR digital filter found by the head transmission function is used. Accordingly, the tone becomes unnatural.

An object of the present invention is to provide a sound image localization processor corresponding to a surround signal, in which the amount of processing can be reduced and a more natural tone is obtained.

DISCLOSURE OF INVENTION

In a sound image localization processor for making a listener feel without using a surround loudspeaker as if a surround signal of a two-channel stereo were outputted from the surround loudspeaker using right and left two loudspeakers which are located ahead of the listener, a first sound image localization processor according to the present invention is characterized by comprising a first processing circuit receiving a surround left signal and comprising a first delay unit and a first sound image localization filter; a second processing circuit receiving a surround right signal and comprising a second delay unit and a second sound image localization filter; an adder for adding the surround left signal and an output signal of the second processing circuit and outputting the result of the addition as a voice signal to the left loudspeaker located ahead of the listener; and an adder for adding the surround right signal and an output signal of the first processing circuit and outputting the result of the addition as a voice signal to the right loudspeaker located ahead of the listener.

In a sound image localization processor for making a listener feel without using a surround loudspeaker as if a surround signal of a two-channel stereo were outputted from the surround loudspeaker using right and left two loudspeakers which are located ahead of the listener, a second sound image localization processor according to the present invention is characterized by comprising a first low-pass filter receiving a surround left signal; a second low-pass filter receiving a surround right signal; a first processing circuit receiving an output signal of the first low-pass filter and comprising a first delay unit and a first sound image localization filter; a second processing circuit receiving an output signal of a second low-pass filter and comprising a second delay unit and a second sound image localization filter; an adder for adding the output signal of the first low-pass filter and an output signal of the second processing circuit and outputting the result of the addition as a voice signal to the left loudspeaker located ahead of the listener; and an adder for adding the output signal of the second low-pass filter and an output signal of the first processing circuit and outputting the result of the addition as a voice signal to the right loudspeaker located ahead of the listener.

A digital delay unit may be used as each of the delay units, and each of the sound image localization filters may be constituted by a plurality of IIR digital filters. An analog delay unit may be used as each of the delay units, and each of the sound image localization filters may be constituted by a plurality of IIR digital filters.

A digital delay unit may be used as each of the delay units, and each of the sound image localization filters may be constituted by a plurality of analog filters. An analog delay unit may be used as each of the delay units, and each of the sound image localization filters may be constituted by a plurality of analog filters.

As a low-pass filter, a digital low-pass filter may be used, or an analog low-pass filter may be used.

BEST MODE FOR CARRYING OUT THE INVENTION

Referring now to FIGS. 1 to 5, embodiments of the present invention will be described.

[1] Description of First Embodiment

Figure 1:
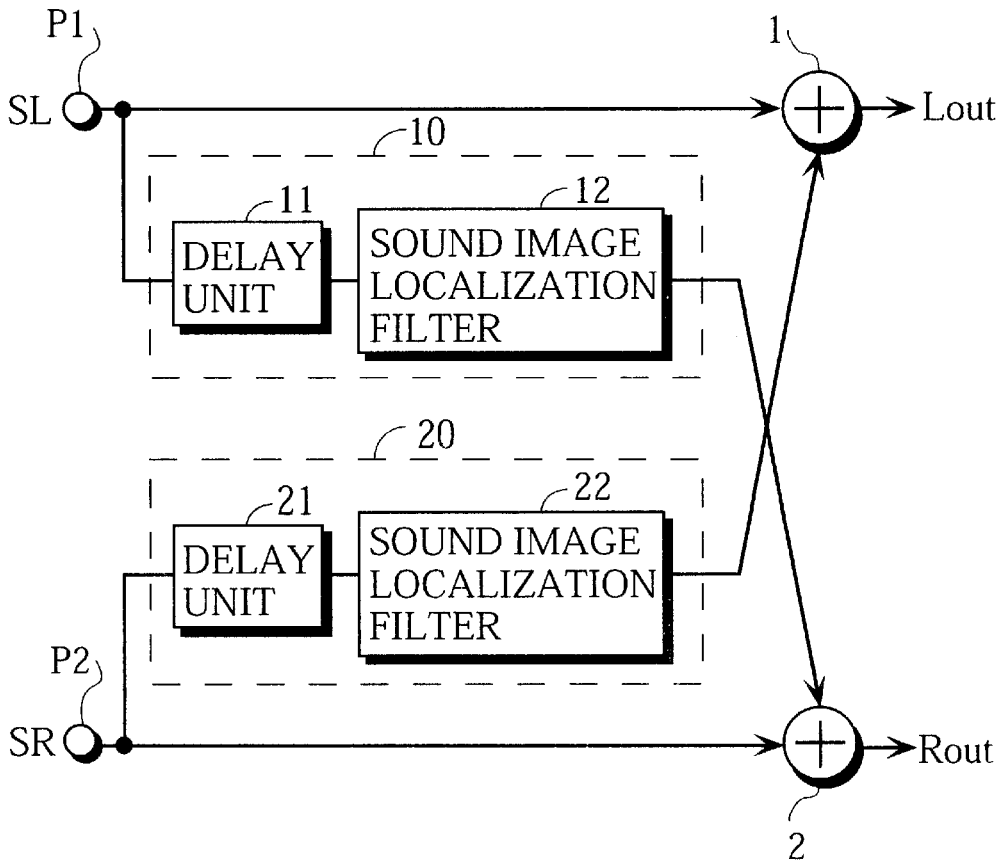
FIG. 1 is a circuit diagram showing a sound image localization processing circuit according to a first embodiment of the present invention.

FIG. 1 illustrates the configuration of a sound image localization processing circuit.

A surround left signal SL inputted to an input terminal P1 is fed to a first adder 1 as well as to a first processing circuit 10 comprising a delay unit 11 and a sound image localization filter 12.

A surround right signal SR inputted to an input terminal P2 is fed to a second adder 2 as well as a second processing circuit 20 comprising a delay unit 21 and a sound image localization filter 22.

In the first adder 1, the surround left signal SL and an output signal of the second processing circuit 20 are added together. An output signal LOUT of the first adder 1 is fed to a left loudspeaker located at the left and ahead of a listener.

In the second adder 2, the surround right signal SR and an output signal of the first processing circuit 10 are added together. An output signal $R_{OUT}$ of the second adder 2 is fed to a right loudspeaker located at the right and ahead of the listener.

As the delay units 11 and 21, either one of a digital delay unit and an analog delay unit may be used. The sound image localization filter 12 and the sound image localization filter 22 have the same characteristics. As the sound image localization filters 12 and 22, a combination of one to five low order IIR (Infinite Impulse Response) digital filters or a combination of one to five analog filters having the same characteristics as those of the IIR digital filter may be used.

In the present embodiment, the digital delay unit is used as the delay units 11 and 21. A hearing experiment proves that 3 to 15 sampling time periods are preferable as the amount of delay. The 3 to 15 sampling time periods are selected in consideration of the respective characteristics and listening positions of the delay units.

Figure 2:
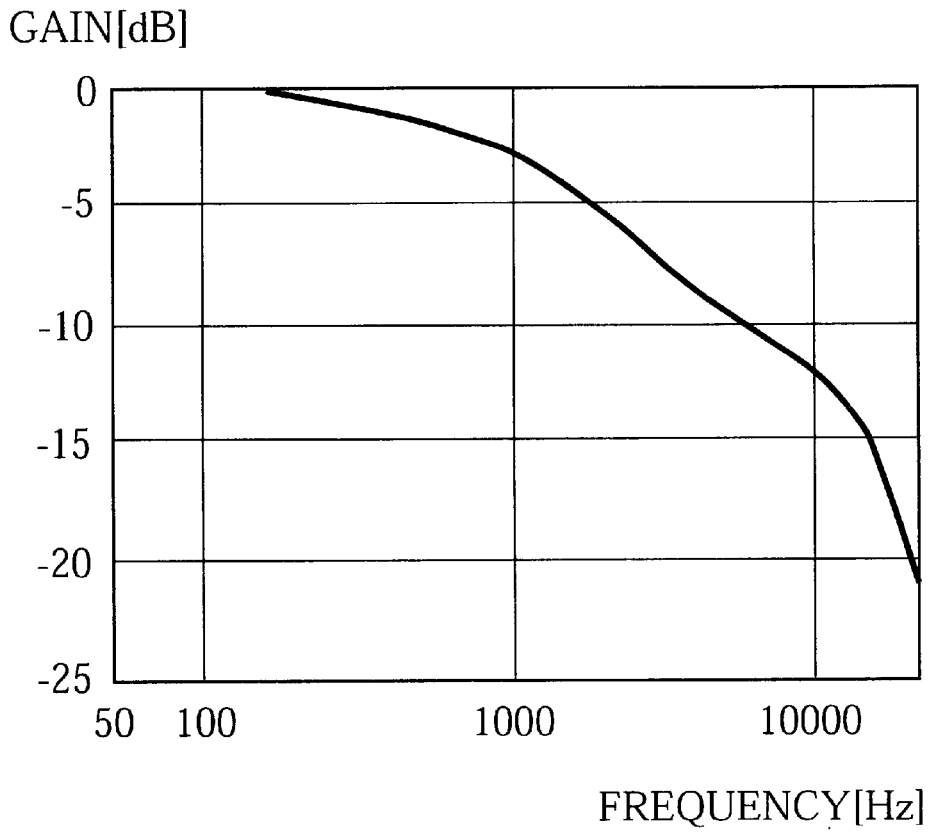
FIG. 2 is a graph showing an example of the characteristics of a secondary IIR digital filter in a case where a series connection of two secondary digital filters is used as a sound image localization filter.

In the present embodiment, a series connection of two secondary IIR digital filters is used as each of the sound image localization filters 12 and 22. An example of the composite frequency characteristics of the secondary IIR digital filter is illustrated in FIG. 2.

As a result, a surround signal can be felt as if it were outputted from a surround loudspeaker. Further, a more natural tone than that in the conventional example is obtained.

When an IIR digital filter or a combination of IIR digital filters is used as each of the sound image localization filters 12 and 22, it is possible to arbitrarily select the characteristics of the IIR digital filter, the number of the IIR digital filters, the order of the IIR digital filter, and a connecting method (in parallel or series) of the IIR digital filters can be arbitrarily selected.

Although in the above-mentioned embodiment, each of the processing circuits 10 and 20 comprises a delay unit whose amount of delay corresponds to 3 to 15 sampling time periods and a sound image localization filter which is a combination of one to five low order IIR digital filters. Accordingly, the amount of processing can be made much smaller, as compared with that in the conventional example using the FIR digital filter. Further, in the low order IIR digital filter, smoother frequency characteristics than that in the FIR digital filter can be obtained, so that a more natural tone is obtained.

Figure 3:
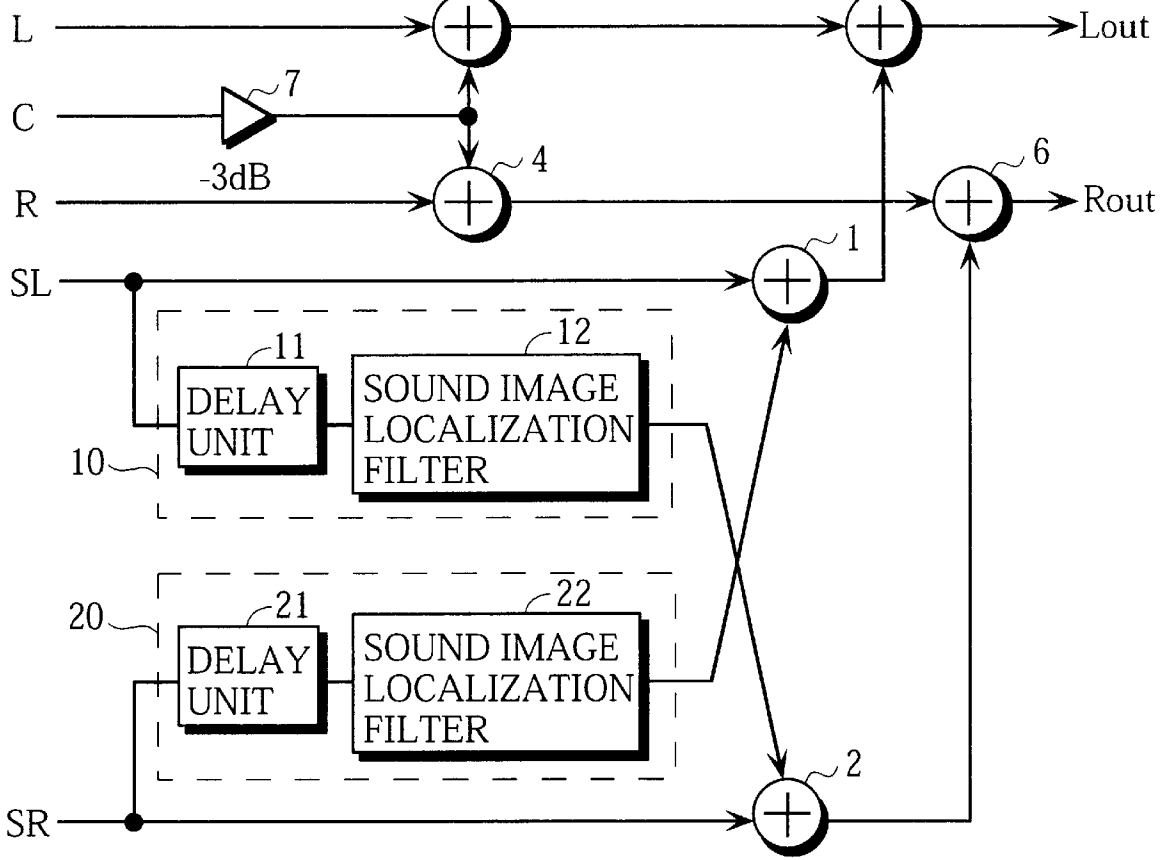
FIG. 3 is a circuit diagram showing a circuit for reproducing a multi-channel audio signal such as DolbyDigital or MPEG only on two channels utilizing a sound image localization processing technique shown in FIG. 1.

FIG. 3 illustrates a circuit for reproducing a multi-channel audio signal such as DolbyDigital or MPEG only on two channels utilizing the sound image localization processing technique shown in FIG. 1. In FIG. 3, the same portions as those shown in FIG. 1 are assigned the same reference numerals.

A left signal L and a right signal R are added to a signal obtained by subjecting a center signal C to gain control of −3 dB by a multiplier 7, respectively, by a third adder 3 and a fourth adder 4.

An output of the third adder 3 and the output of the first adder 1 described in FIG. 1 are added together by a fifth adder 5, and the result of the addition is taken as an output $L_{OUT}$ to a left loudspeaker. An output of the fourth adder 4 and the output of the second adder 2 described in FIG. 1 are added together by a sixth adder 6, and the result of the addition is taken as an output $R_{OUT}$ to a right loudspeaker.

In such a circuit, the amount of processing is reduced, and a more natural tone is obtained, as in the circuit shown in FIG. 1.

[2] Description of Second Embodiment

Figure 4:
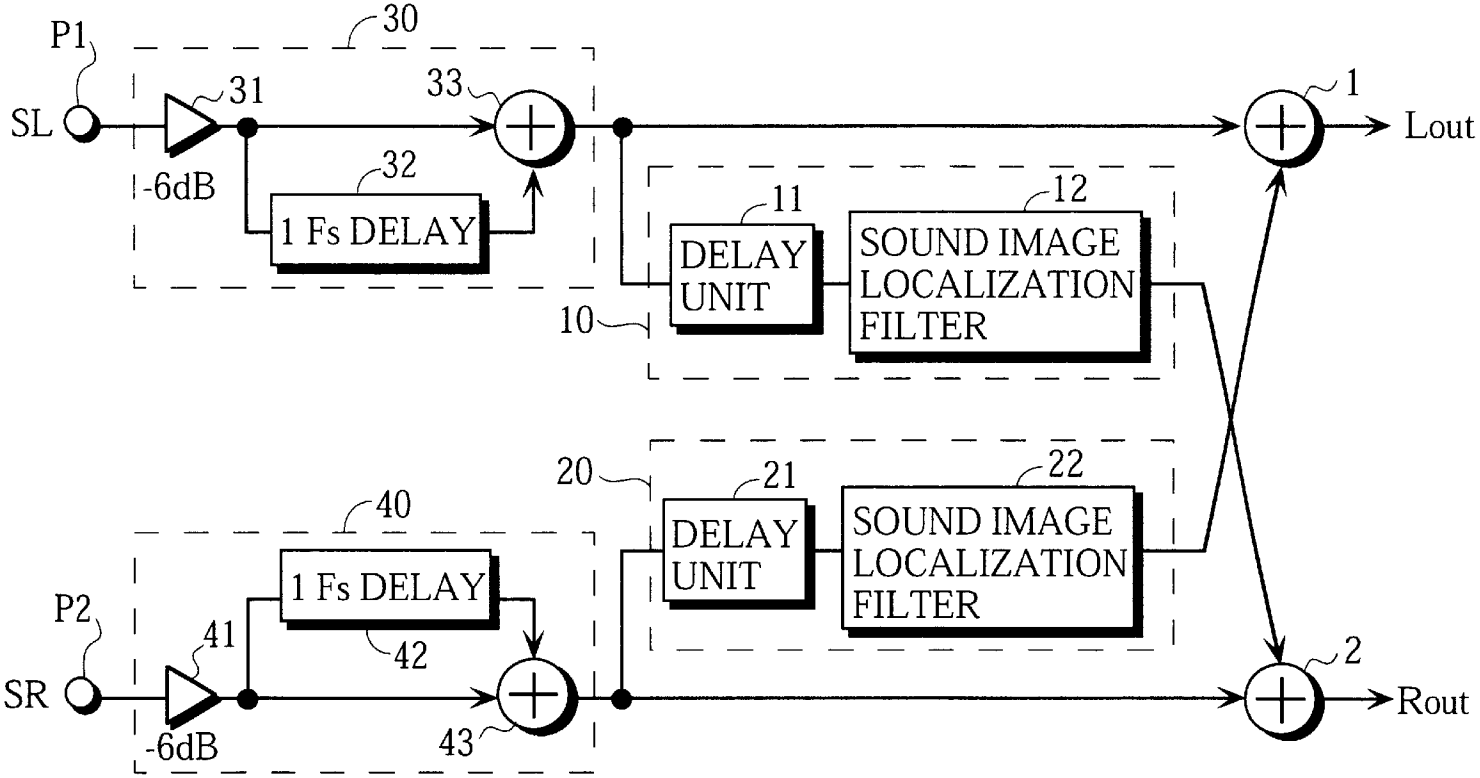
FIG. 4 is a circuit diagram showing a sound image localization processing circuit according to a second embodiment of the present invention.

FIG. 4 illustrates the configuration of a sound image localization processing circuit. In FIG. 4, the same portions as those shown in FIG. 1 are assigned the same reference numerals and hence, the description thereof is not repeated.

In the circuit, a surround left signal SL inputted to an input terminal P1 is fed to a first adder 1 through a first low-pass filter 30 as well as to a first processing circuit 10 comprising a delay unit 11 and a sound image localization filter 12.

Similarly, a surround right signal SR inputted to an input terminal P2 is fed to a second adder 2 through a second low-pass filter 40 as well as to a second processing circuit 20 comprising a delay unit 21 and a sound image localization filter 22.

Specifically, the circuit differs from the circuit shown in FIG. 1 in that the low-pass filters 30 and 40 for relieving an uncomfortable feeling in a high frequency band. As the low-pass filters 30 and 40, a digital low-pass filter may be used, or an analog low-pass filter may be used.

The first low-pass filter 30 comprises a multiplier 31 for subjecting the input signal SL to gain control of −6 dB, a delay unit 32 for delaying an output signal of the multiplier 31 by one sampling time period, and an adder 33 for adding the output signal of the multiplier 31 and an output signal of the delay unit 32 together in this example.

The second low-pass filter 40 comprises a multiplier 31 for subjecting the input signal SR to gain control of −6 dB, a delay unit 42 for delaying an output signal of the multiplier 41 by one sampling time period, and an adder 43 for adding the output signal of the multiplier 41 and an output signal of the delay unit 42 together in this example.

Figure 5:
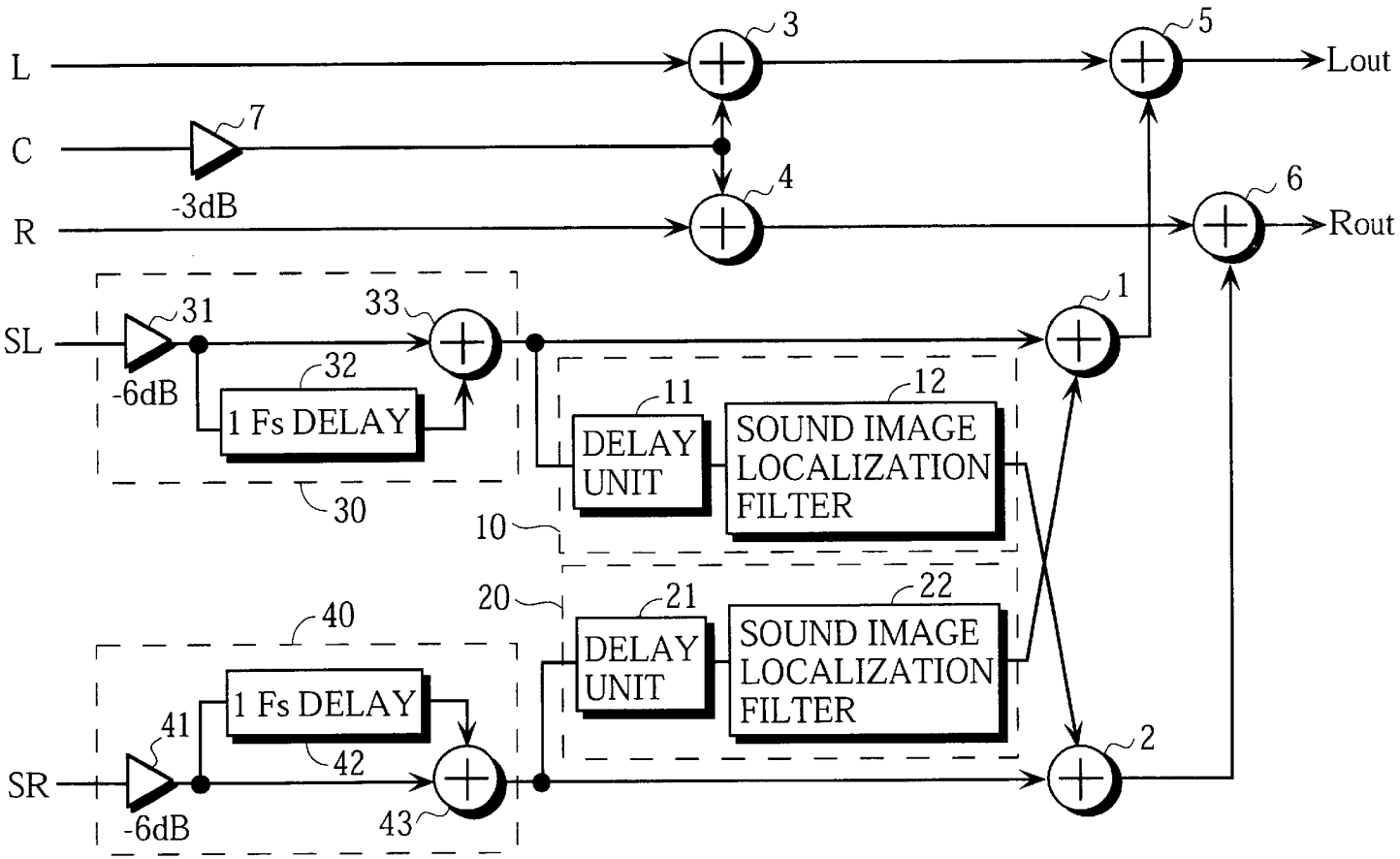
FIG. 5 is a circuit diagram showing a circuit for reproducing a multi-channel audio signal such as DolbyDigital or MPEG only on two channels utilizing a sound image localization processing technique shown in FIG. 4.
Figure 6:
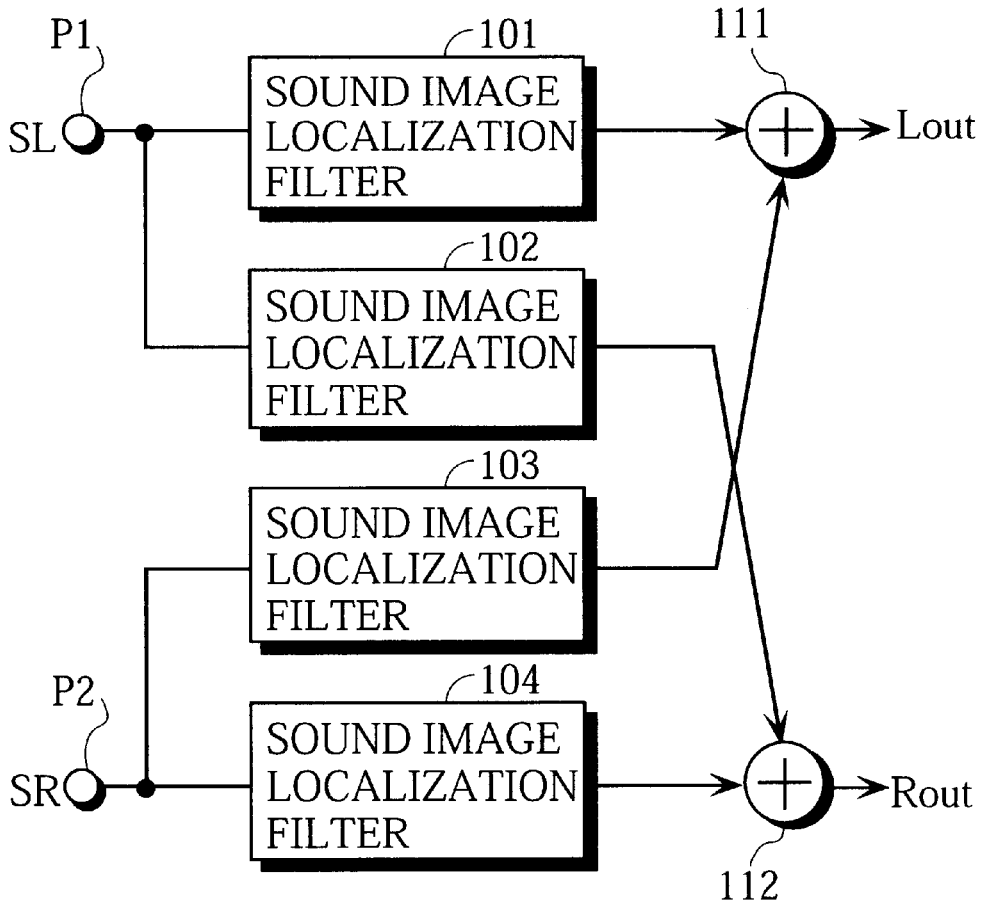
FIG. 6 is a circuit diagram showing a conventional sound image localization processing circuit.
Figure 7:
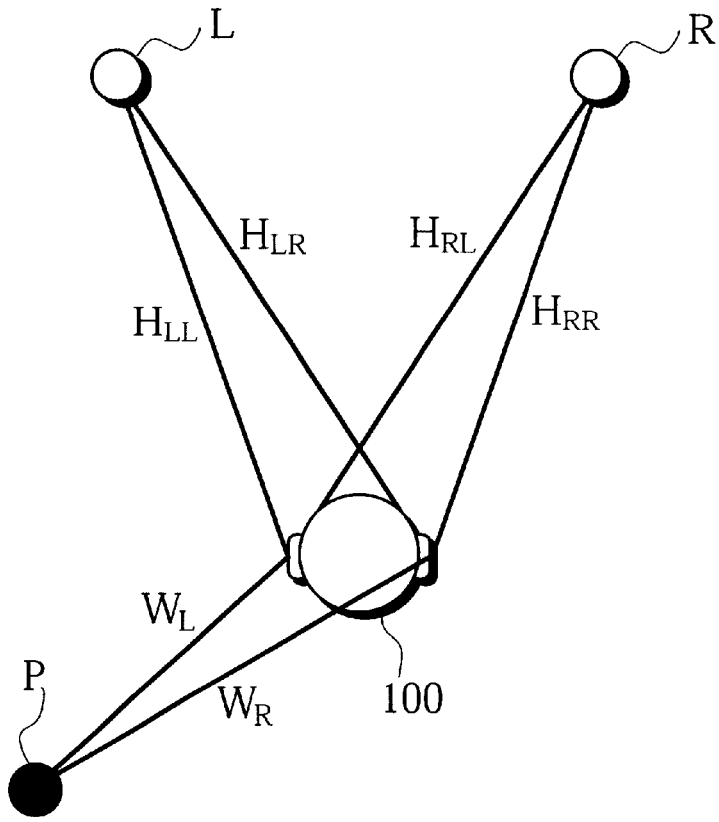
FIG. 7 is a schematic view for explaining a method of calculating a sound image localization filter using a head transmission function.
Figure 8:
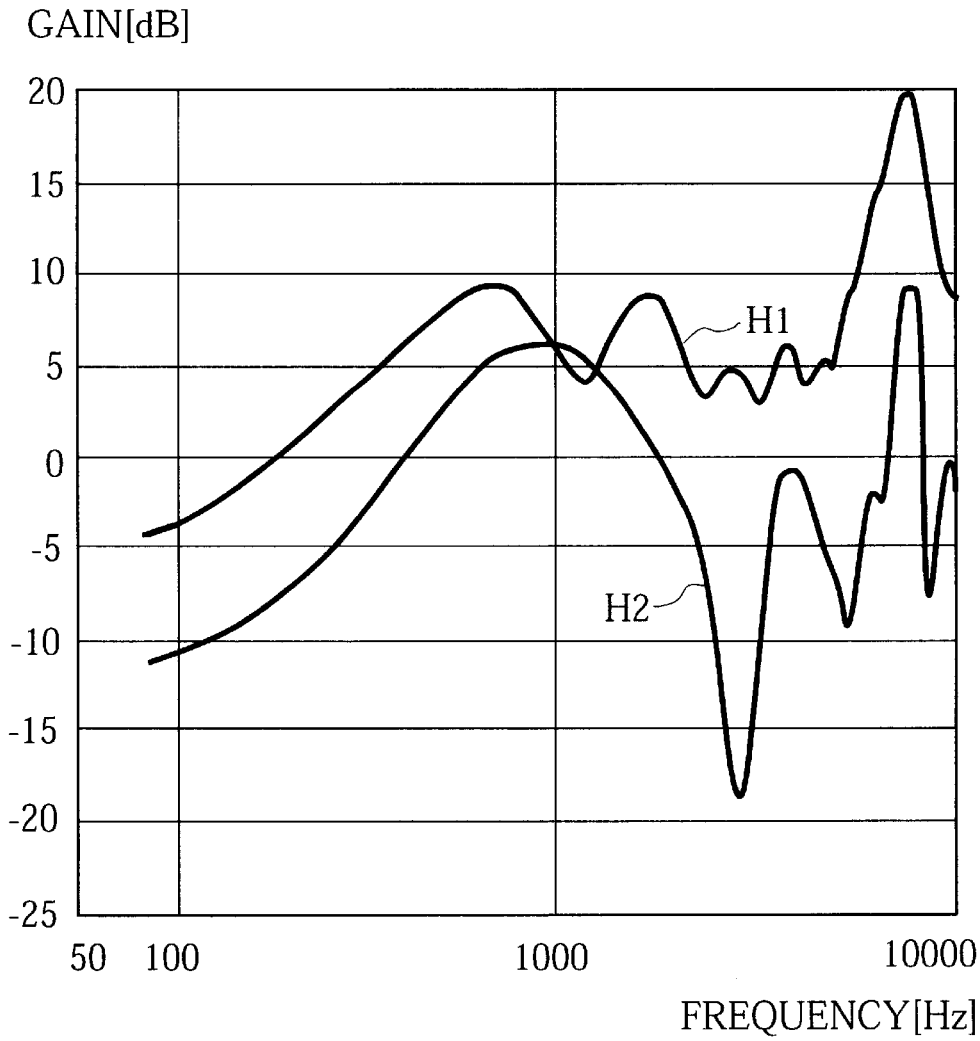
FIG. 8 is a graph showing an example of the frequency characteristics of an FIR digital filter used for the sound image localization processing circuit shown in FIG. 6.
Figure 9:
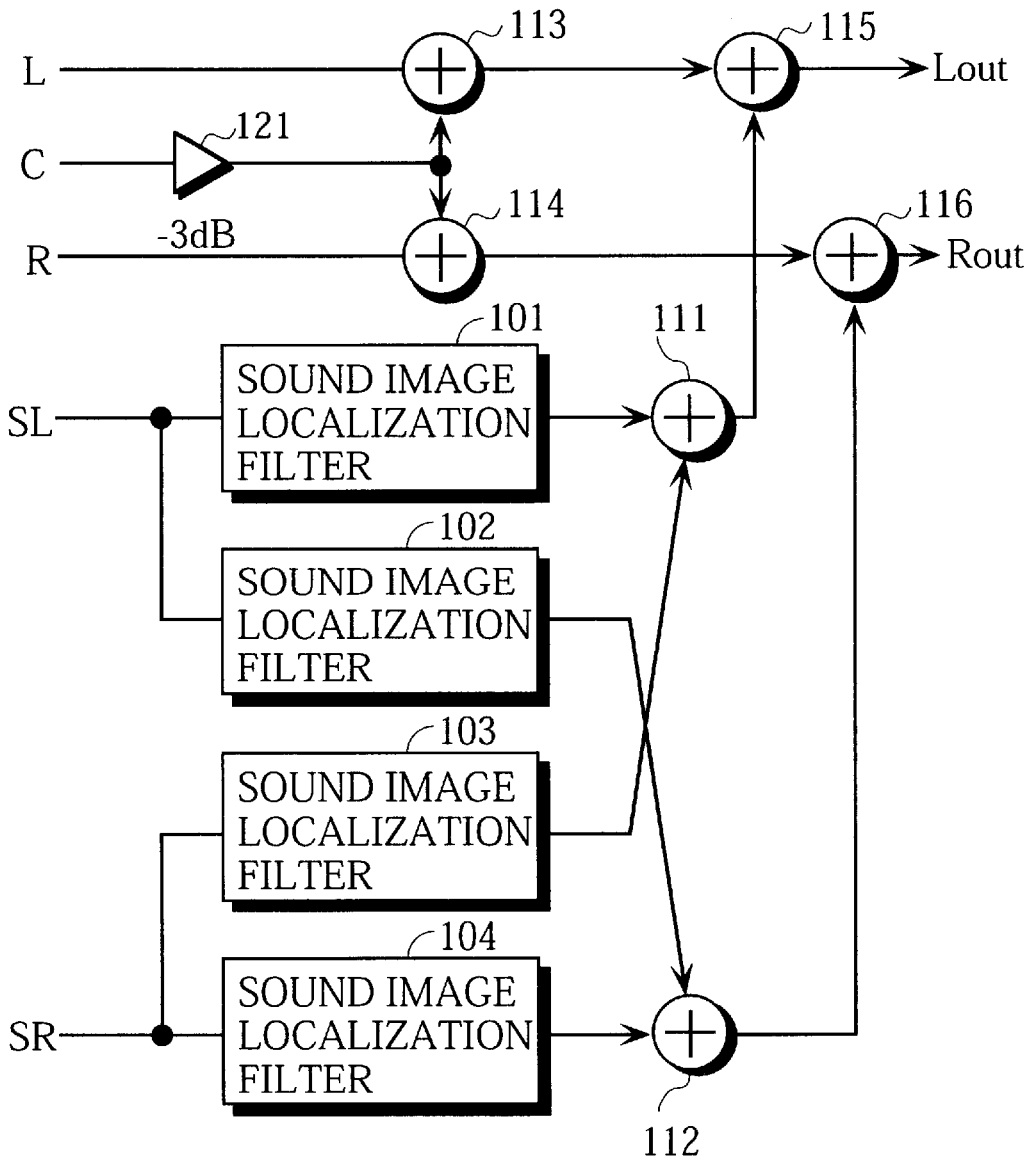
FIG. 9 is a circuit diagram showing a circuit for reproducing a multi-channel audio signal such as DolbyDigital or MPEG only on two channels utilizing a sound image localization processing technique shown in FIG. 6.

FIG. 5 illustrates a circuit for reproducing a multi-channel audio signal such as DolbyDigital or MPEG only on two channels utilizing the sound image localization processing technique shown in FIG. 4. In FIG. 5, the same portions as those shown in FIG. 4 are assigned the same reference numerals.

A left signal L and a right signal R are added to a signal obtained by subjecting a center signal C to gain control of −3 dB, respectively, by a third adder 3 and a fourth adder 4.

An output of the third adder 3 and an output of the first adder 1 are added together by a fifth adder 5, and the result of the addition is taken as an output $L_{OUT}$ to a left loudspeaker. An output of the fourth adder 4 and an output of the second adder 2 are added together by a sixth adder 6, and the result of the addition is taken as an output $R_{OUT}$ to a right loudspeaker.

What is claimed is:

1. In a sound image localization processor for making a listener feel without using a surround loudspeaker as if a surround signal of a two-channel stereo were outputted from the surround loudspeaker using right and left two loudspeakers which are located ahead of the listener, the sound image localization processor characterized by comprising:

a first processing circuit receiving a surround left signal and comprising a first delay device and a first sound image localization filter;

a second processing circuit receiving a surround right signal and comprising a second delay device and a second sound image localization filter;

an adder for adding the surround left signal and an output signal of the second processing circuit and outputting the result of the addition as a voice signal to the left loudspeaker located ahead of the listener; and an adder for adding the surround right signal and an output signal of the first processing circuit and outputting the result of the addition as a voice signal to the right loudspeaker located ahead of the listener.

2. In a sound image localization processor for making a listener feel without using a surround loudspeaker as if a surround signal of a two-channel stereo were outputted from the surround loudspeaker using right and left two loudspeakers which are located ahead of the listener, the sound image localization processor characterized by comprising:

a first low-pass filter receiving a surround left signal;

a second low-pass filter receiving a surround right signal;

a first processing circuit receiving an output signal of the first low-pass filter and comprising a first delay device and a first sound image localization filter;

a second processing circuit receiving an output signal of a second low-pass filter and comprising a second delay device and a second sound image localization filter;

an adder for adding the output signal of the first low-pass filter and an output signal of the second processing circuit and outputting the result of the addition as a voice signal to the left loudspeaker located ahead of the listener; and an adder for adding the output signal of the second low-pass filter and an output signal of the first processing circuit and outputting the result of the addition as a voice signal to the right loudspeaker located ahead of the listener.

3. The sound image localization processor according to either one of claims 1 and 2, wherein each of the delay devices is a digital delay device, and each of the sound image localization filters is constituted by a plurality of IIR digital filters.

4. The sound image localization processor according to either one of claims 1 and 2, wherein each of the delay devices is an analog delay device, and each of the sound image localization filters is constituted by a plurality of IIR digital filters.

5. The sound image localization processor according to either one of claims 1 and 2, wherein each of the delay devices is a digital delay device, and each of the sound image localization filters is constituted by a plurality of analog filters.

6. The sound image localization processor according to either one of claims 1 and 2, wherein each of the delay devices is an analog delay device, and each of the sound image localization filters is constituted by a plurality of analog filters.

* * * * *